US007360804B1

(12) United States Patent
Fidali et al.

(10) Patent No.: US 7,360,804 B1
(45) Date of Patent: Apr. 22, 2008

(54) ARTICLES, SYSTEMS, AND METHODS FOR SUPPRESSING NOISE AND/OR VIBRATIONS IN HOTEL/MOTEL DOORS

(75) Inventors: Wlodzimierz Fidali, Brooklyn, NY (US); Robert T. Logan, New York, NY (US)

(73) Assignee: Senduay Corp, New York, NY (US)

( * ) Notice: Subject to any disclaimer, the term of this patent is extended or adjusted under 35 U.S.C. 154(b) by 0 days.

(21) Appl. No.: 11/610,843

(22) Filed: Dec. 14, 2006

(51) Int. Cl.
*E05C 17/04* (2006.01)
*E05C 19/18* (2006.01)

(52) U.S. Cl. ..... 292/262; 292/288; 292/DIG. 15; 292/DIG. 56; 16/82

(58) Field of Classification Search ..... 292/262, 292/288, 268–270, 338, 339, DIG. 15, DIG. 56; 16/82
See application file for complete search history.

(56) References Cited

U.S. PATENT DOCUMENTS

| | | | | | |
|---|---|---|---|---|---|
| 372,326 | A | * | 11/1887 | Palmenberg | 292/268 |
| 1,354,876 | A | * | 10/1920 | Biegacki | 292/262 |
| 2,029,711 | A | * | 2/1936 | Frantz | 16/86 A |
| 3,055,043 | A | * | 9/1962 | Luttner, Jr. | 16/86 B |
| 3,187,372 | A | * | 6/1965 | Parsons | 16/375 |
| 3,894,356 | A | * | 7/1975 | Imhoff | 49/366 |
| 4,190,926 | A | | 3/1980 | Cronin | |
| 4,725,084 | A | | 2/1988 | Catricola | |
| 4,891,906 | A | | 1/1990 | Knapp | |
| 4,982,474 | A | * | 1/1991 | Kjellstrom | 16/82 |
| 5,018,415 | A | * | 5/1991 | Hawley | 81/15.9 |
| 5,862,570 | A | * | 1/1999 | Lezuch et al. | 16/82 |
| 6,343,818 | B1 | | 2/2002 | Kuramochi | |
| 6,401,396 | B1 | | 6/2002 | Koban et al. | |
| 6,760,954 | B1 | | 7/2004 | Rucker | |
| 6,802,155 | B1 | | 10/2004 | Kawabata et al. | |
| 6,883,841 | B2 | | 4/2005 | Kawabata et al. | |
| 2002/0024223 | A1 | | 2/2002 | Bolduc et al. | |

FOREIGN PATENT DOCUMENTS

GB 2258270 * 2/1993

OTHER PUBLICATIONS

Other product catalogues, pp. 1-5.

* cited by examiner

*Primary Examiner*—Carlos Lugo
(74) *Attorney, Agent, or Firm*—Daniar Hussain

(57) ABSTRACT

A door guard for hotel/motel doors comprises two articles, one article to be attached to a door, and another article to be attached to a door frame. One article is attached to the door, including a hook element adapted to receive a latch member of the door guard and attached to an inside surface of the door; and a damping element, composed of a sound dampening material, attached to an outside surface of the door. Another article is attached to the door frame, including a hinge element for connecting the article to the door frame; and a latch member pivotally connected to the hinge element. Another sound damping element, also composed of a sound dampening material, is disposed between the hinge element and the latch member. When the door guard is released and the door closes, the attached articles reduce the sound and/or vibrations, which are disturbing to hotel/motel guests, that occur when the closing door impacts the door guard and door frame.

4 Claims, 15 Drawing Sheets

(Not Drawn to Scale)

100

(Not Drawn to Scale)

(Not drawn to Scale)

Figure 4A (Not drawn to scale)
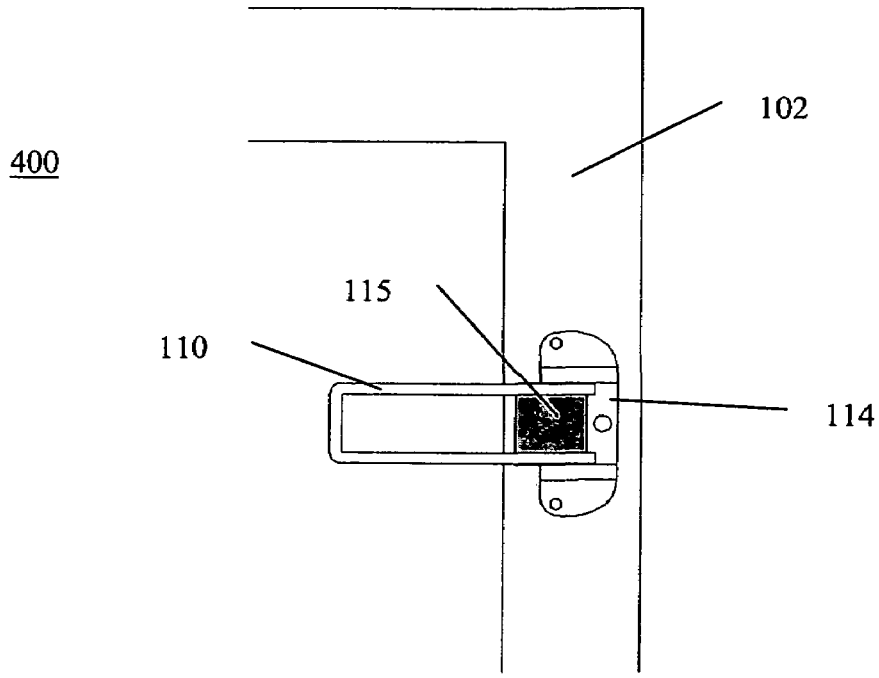
Figure 4B (Not drawn to scale)
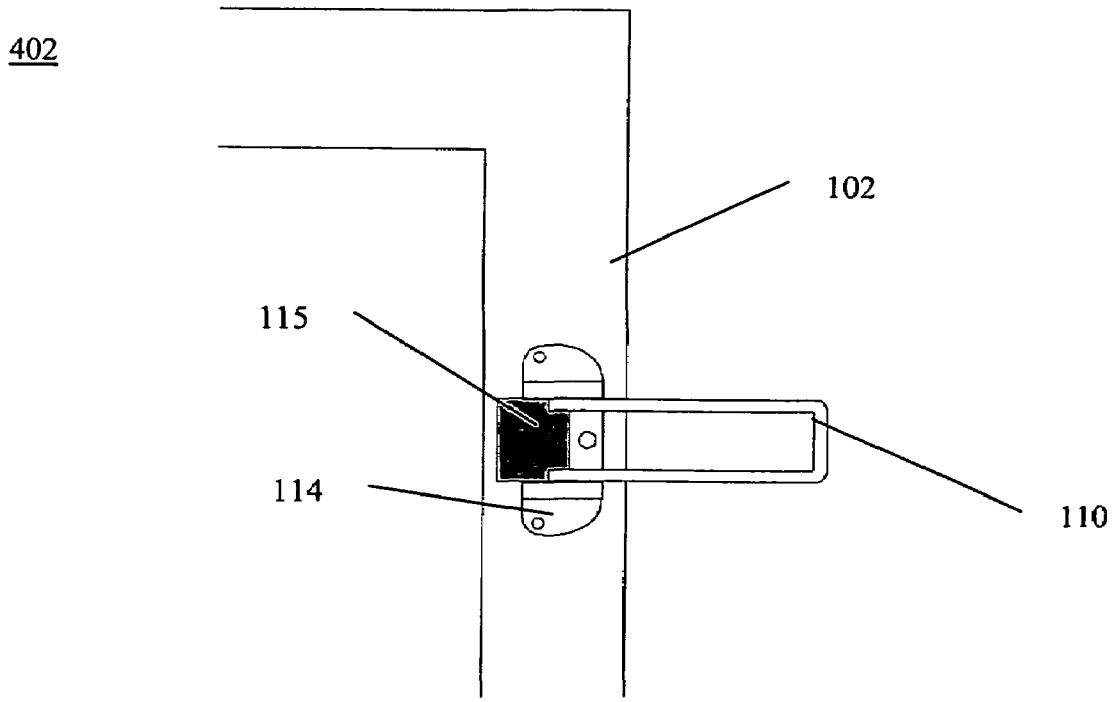

Figure 5 (Not drawn to scale)
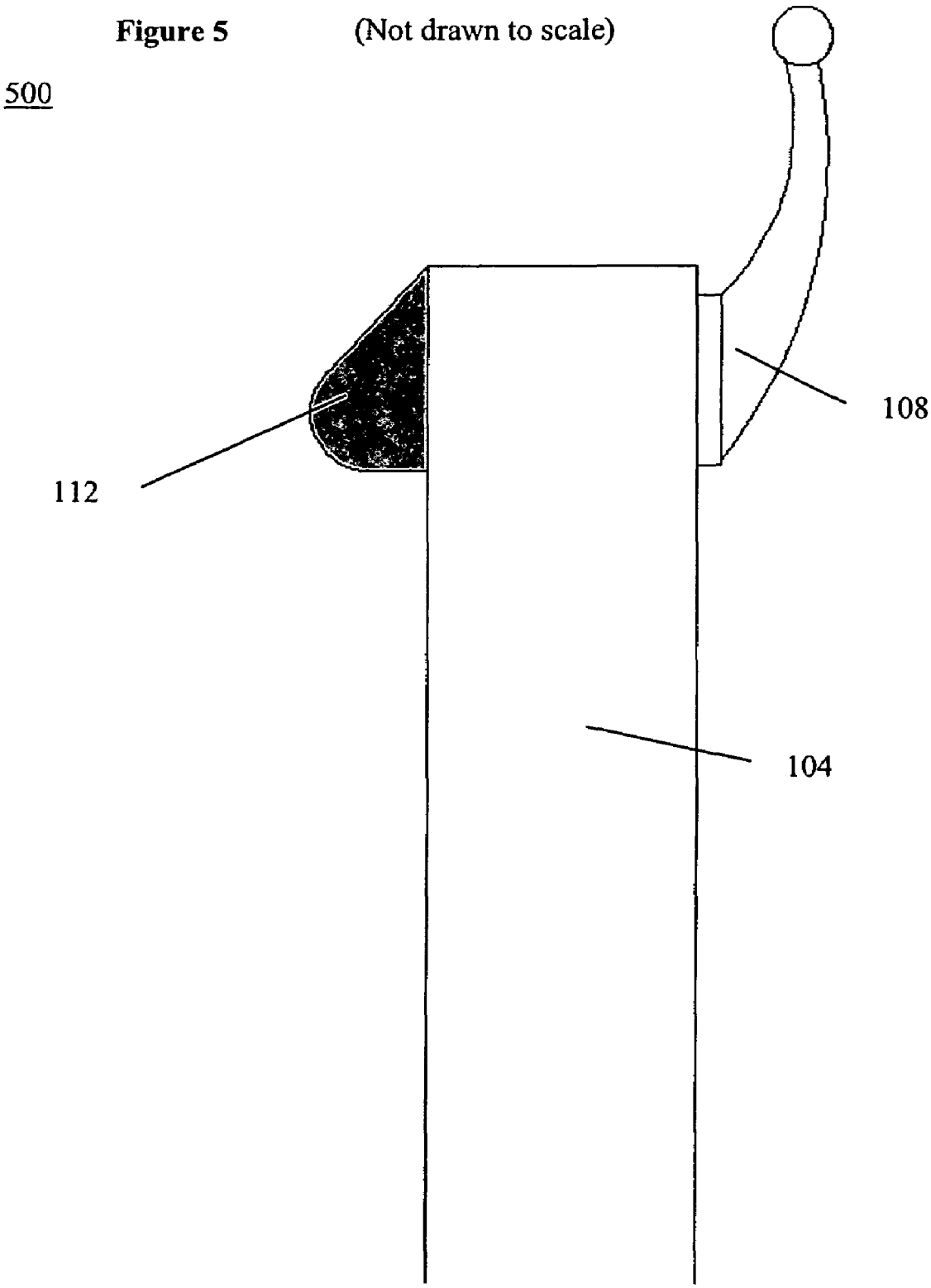

(Not drawn to scale)

(Not drawn to scale)

(Not drawn to scale)

800

ARTICLES, SYSTEMS, AND METHODS FOR SUPPRESSING NOISE AND/OR VIBRATIONS IN HOTEL/MOTEL DOORS

FIELD OF THE INVENTION

The present invention relates to a slide door lock used for hotel and motel doors. More particularly, the present invention relates to an article attached to a door and door frame for reducing the noise, friction, and vibrations between the hinge, door, and latch member of a door guard system. The present invention is primarily intended for slide locks used with either hotel or motel doors, but is not limited to such doors.

BACKGROUND OF THE INVENTION

This invention relates to hotel and motel door guards, and more particularly to a noiseless apparatus best adapted for use with doors of hotels and motels which are concerned with the comfort of their guests. That is, when a door guard is engaged, preventing the door from locking inadvertently, the contact of the door with the door guard creates considerable noise and/or vibrations. In general, this invention may be applied to doors and door guards to reduce noise and/or vibrations when the door inadvertently closes.

There are known and used extensively door closers for commercial doors consisting of a metal rack and pinion, hydraulic fluid, and lubricated latches with various speeds of operation. Hotels and motels typically do not install these types of door closers to guest doors due to the expense and maintenance associated with such door closers. The slamming noise and vibrations caused by the door and door frame interaction corresponding to the mechanics of the door guard apparatus is significantly disturbing to guests, maids, maintenance workers, and other hotel/motel personnel.

U.S. Pat. No. 6,343,818 to Kuramochi discloses a door guard for locking a door in a predetermined half-open position (i.e., one of the positions between fully open and fully closed positions).

U.S. Patent Publication 2002/0024223 to Bolduc et al. discloses a slider for use with a slide lock of the type having a guide support and a latch slideably movable through apertures of the guide support. The slider includes a channel extending inside the main body from a first surface to a second surface thereof, the channel being shaped and sized to allow the latch of the slide lock to freely slide therethrough. The channel is further devised to reduce friction and vibrations of the latch sliding through the channel of the slider.

U.S. Pat. No. 4,891,906 to Knapp discloses an interlocking door guard that securely covers and is attached to the outside of doors that open inward, which uses a full length pendulum torsion rod assembly on the hinge side of the door as well as guides in connection therewith and matching receptacles in and/or on both vertical casing members to accommodate mating sections of the door guard.

U.S. Pat. No. 4,190,926 to Cronin discloses a door guard for a swingable door that is mounted in a doorway having a door closer affixed to the doorway that permits the door to open beyond the point which would normally be the widest open position allowed by the door closer and slows the rate of movement of the door so as to prevent damage to the door, door closer, or doorway.

U.S. Pat. No. 4,725,084 to Catricola discloses a door guard to deter unauthorized entry that includes a pair of complimentary structural members having complimentary cross-sectional configurations to define interlocking portions that will engage to secure the free end of the door to the adjacent door frame. One of the complementary members is secured along the free end of the door and the other member is secured to the adjacent door jamb or frame, where any effort to force the door, as with a prying tool, will cause the interlocking portions to engage and thereby prohibit the door from being force opened.

U.S. Pat. No. 6,802,155 to Kawabata et al. discloses a door opening/closing mechanism fitted on a door that closes and opens an opening formed in the body of an apparatus by being brought into and out of contact with the rim of the opening which has cam mechanisms that permit the door to engage with and disengage from the body of the door.

The related art in general disclose door guards and slide door locks that prevent burglary and forced entry. None of the related art address the problems associated with the slamming noise and vibrations when a door strikes a door guard. Therefore, it would be an advancement in the state of the art to provide an improvement to a door guard for hotel/motel doors which reduces the noise, friction, and vibrations between the hinge, door, and latch member of a door guard system.

SUMMARY OF THE INVENTION

It is therefore an object of this invention to prevent the production of a harsh loud sound upon contact between a door and a door guard attached to a frame of the door when releasing the door.

The present invention relates to a door guard setup where, when the door guard is released and the door swings closed, a slamming sound and vibrations occurs. To remedy this, two articles are attached, one article to the door and another article to the door frame. When the door guard is released causing the door to close, the attached articles reduces the sound and vibration of the door, resulting in a sound of a single decibel. Therefore, a simple and cost effective device is easily installed and easily maintained.

Accordingly, an embodiment of the present invention is an article to be attached to a door for suppressing sound when the door strikes a door latch. This article includes a hook element adapted to receive a latch member of the door latch and attached to an inside surface of the door; and a damping element, composed of a sound dampening material, attached to an outside surface of the door. The sound dampening material could be a rubber, or any other material capable of damping sound and/or reducing vibrations.

Another embodiment of the present invention is an article to be attached to a door frame for suppressing sound when a door strikes the door frame. The article includes a hinge element for connecting said article to the door frame, and a latch member pivotally connected to the hinge element and adapted to latch with a hook. A damping element, composed of a sound dampening material, is disposed between the hinge element and the latch member.

Yet another embodiment of the present invention is a system for suppressing noise when a door strikes a door latch on a door frame. The door includes a hook member attached to an inside surface of the door and a first damping element, composed of a sound dampening material, attached to an outside surface of the door. The door frame comprises a hinge element attached to the door frame at a same height as the hook member, and a latch member pivotally connected to the hinge element and adapted to latch with the hook member. A second damping element, composed of a sound dampening material, is disposed between the hinge element and the latch member.

Yet another embodiment of the present invention is a system for suppressing noise when a door strikes a door frame. The system includes a hook member attached to an inside surface of the door. A first damping element, composed of a sound dampening material, is attached to an outside surface of the door. A hinge element is attached to the door frame at a same height as the hook member. A latch member is pivotally connected to the hinge element and adapted to latch with the hook member. A second damping element, composed of a sound dampening material, is disposed between the hinge element and the latch member.

Yet another embodiment of the present invention is a system for suppressing noise when a door strikes a door latch of a door frame. A first damping element, composed of a sound dampening material, attached to an outside surface of the door. A second damping element, composed of a sound dampening material, is disposed between a hinge element and a latch member of the door latch.

Yet another embodiment of the present invention is an article to be attached to a door for suppressing sound when the door strikes a door latch. The article includes a damping element, composed of a sound dampening material. A separator element, adapted to be attached to an outside surface of the door, is connected to the damping element. An extension element, connected at approximately a right angle to a bottom surface of the damping element, is adapted to be attached to a side surface of the door.

Yet another embodiment of the present invention is an article to be attached to a door latch of a door frame, for suppressing sound when a door strikes the door latch, the door latch having a hinge element and a latch member pivotally connected to the hinge element. The article includes a damping element, composed of a sound dampening material, disposed between the hinge element and the latch member. A separator element, such as a washer, is disposed between the damping element and the door frame.

Yet another embodiment of the present invention is an article to be attached to a door. The article includes hook means for receiving a latch member, which latch member is attached to a door frame. The hook means is adapted to be attached to an inside surface of the door. A damping means is provided for dampening sound and is attached to an outside surface of the door.

Yet another embodiment of the present invention is a method for reducing sound when a door strikes a door frame with a door latch, the door latch having a latch member pivotally connected to a hinge. The method includes the steps of attaching a first damping element to the door at a same height as the door latch, and attaching a second damping element between the hinge and the latch member of the door latch.

In the method described above, when the door strikes the latch member of the door latch, the first damping element decreases sound of collision of the door with the latch member, and the second damping element decreases sound of collision of the latch member with the hinge. Accordingly, when the door strikes the latch member of the door latch, the sound produced is reduced compared to without the use of the first damping element or the second damping element.

Other embodiments of the present invention include door guards. The door guards include a hinge and a latch pivotally connected to the hinge. A damper, composed of a sound dampening material, is disposed between the hinge and the latch. In the door guards described above, the hinge could be a metal plate with holes for screws, and the damper could be approximately "L-shaped."

Other embodiments of the present invention include the door guards described above, and also including a hook adapted to receive the latch, and a second damper, composed of a sound dampening material, adapted to be attached to an outside surface of the door. The door guards described above can also include an approximately "C-shaped" metal plate attached to the hook and the second damper, having holes for screws. In the door guards described above, the second damper could be approximately "D-shaped."

Other objects, advantages, and embodiments of the present invention will become apparent when considered in conjunction with the following detailed description and the attached drawings, and it is intended that these objects and advantages are within the scope and spirit of the present invention.

To accomplish the above and related objects, this invention may be embodied in the form illustrated in the accompanying drawings. However, the drawings are illustrative only, and changes may be made in the specific construction illustrated therein without departing from the spirit and scope of the invention.

BRIEF DESCRIPTION OF THE DRAWINGS

Various other objects, features and attendant advantages of the present invention will become fully apparent when considered in conjunction with the accompanying drawings, in which like reference characters designate the same or similar parts throughout the several views, and in which:

FIG. 4A is a perspective view of the frame sound damper and latch in a closed position;

FIG. 4B is a perspective view of the frame sound damper and latch in an open position;

FIG. 5 is an above perspective view of a door sound damper and its placement in view of the door and hook;

DETAILED DESCRIPTION

Figure 1A:
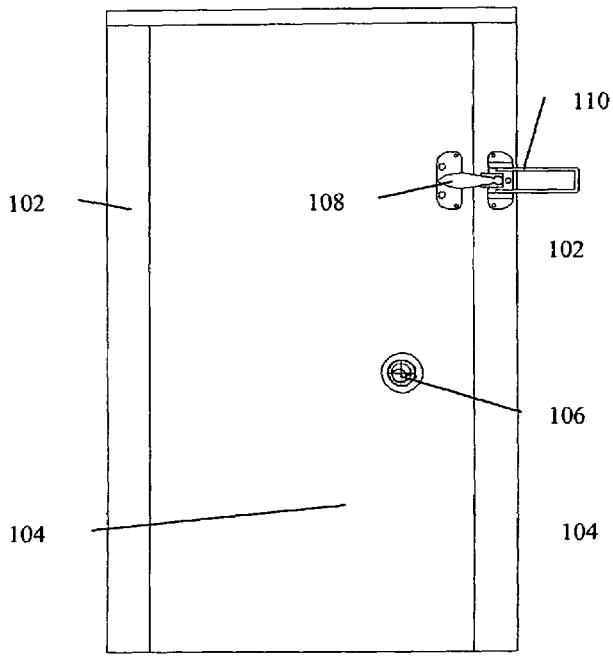
FIG. 1A is a perspective of an open door guard in view of a door and door frame.

It is noted that in this disclosure and particularly in the claims and/or paragraphs, terms such as "comprises," "comprised," "comprising," and the like can have the meaning attributed to it in U.S. patent law; that is, they can mean "includes," "included," "including," and the like, and allow for elements not explicitly recited. Terms such as "consisting essentially of" and "consists essentially of" have the meaning ascribed to them in U.S. patent law; that is, they allow for elements not explicitly recited, but exclude elements that are found in the prior art or that affect a basic or novel characteristic of the invention. These and other embodiments are disclosed or are apparent from and encompassed by, the following description.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. In addition, it is to be understood that the phraseology and terminology employed herein are for the purpose of the description and should not be regarded as limiting. Furthermore, as will be apparent to those skilled in the art, the present invention may be embodied in other specific forms without departing from the essential characteristics thereof.

For purposes of the description of the drawings and the embodiments of the present invention, as mentioned in FIGS. 1-7, those figure are not drawn to scale. Some areas are drawn bigger and/or simpler for emphasis and in order to more clearly portray embodiments of the present invention. It is to be understood that the elements relating to a door, door frame, door knob, door hinge, and door guard (latch and hook) are well known in the art, and do not need detailed description or explanation.

FIG. 1A is a full perspective view 100 of a door guard in view of a door and door frame. The door frame 102 will be understood by one of ordinary skill in the art as the frame of a doorway, including two jambs and a lintel, or head. Also understood by one of ordinary skill, are the door 104 and door knob 106, which can be described as any gateway marking an entrance or exit from one place to another, and the handle or knob by which a door is opened or closed, respectively. (As is readily apparent, the present invention may be applied equally to a "left door" with a left-open mechanism, or to a "right door" with a right-open mechanism, even though a left door or a right door may be illustrated in the drawings.) Accompanying this combination of the door frame 102, door 104, and door knob 106, is a door guard, which will also be understood by one of ordinary skill. The door guard includes two components, a hook 108 and a latch 110. The hook 108 is connected to the inside surface of the door 104 which swings inward in the direction of the room (out of the page in FIG. 1A). The hook 108 is also positioned on the door at a prescribed distance so that the hook 108 and latch 110 can be engaged and/or disengaged. The latch 110 is positioned at an equal height on the door frame 102, as shown. In FIG. 1A, the hook 108 and latch 110 are in an opened position.

Figure 1B:
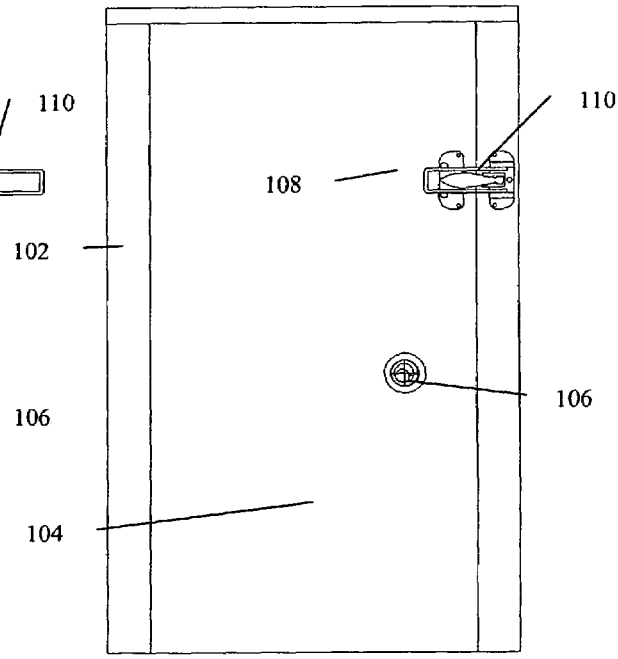
FIG. 1B is a perspective of a closed door guard in view of a door and door frame.

FIG. 1B is a perspective view of a hook 108 and a latch 110 in view of a door 104 and door frame 102. As shown, the hook 108 and latch 110 are engaged or closed. When this occurs, the door 104 is locked and cannot be fully opened, as will be readily appreciated by one of ordinary skill.

Figure 2:
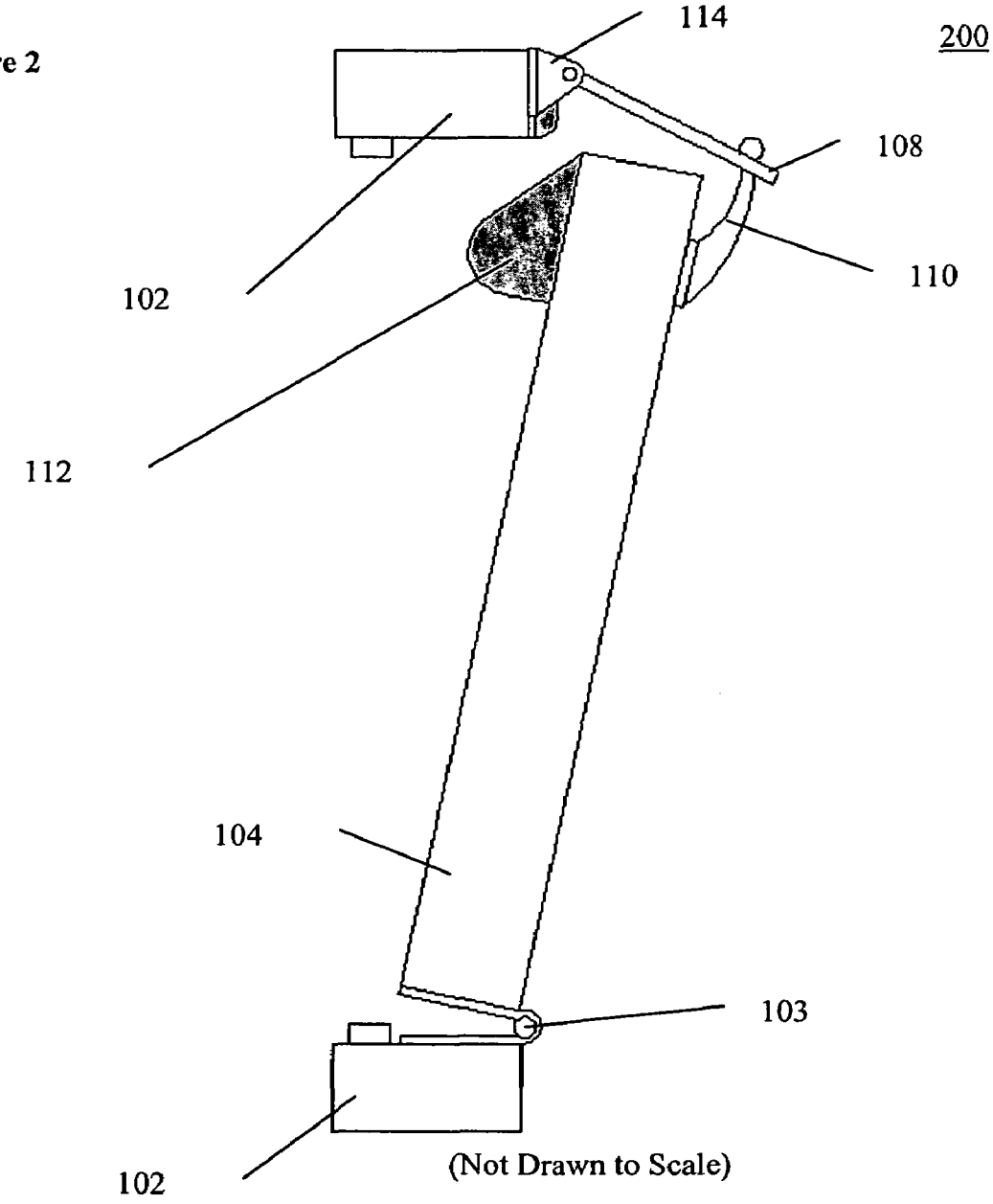
FIG. 2 is an above perspective of the door guard, door, and door frame components and their interaction when the door guard is engaged or closed.

FIG. 2 is an above perspective 200 of a door locking system and the manner in which each component interacts. The door locking system 200 includes door frame 102, door 104, door hinge 103, hook 108 and latch 110. The door hinge 103 is a jointed device or flexible piece on which the door 104 turns, swings, or moves. As shown in FIG. 2, latch 110 and hook 108 are engaged upon an attempt to open door 104, and the latch 110 and hook 108 prevent the door from opening fully.

Figure 3:
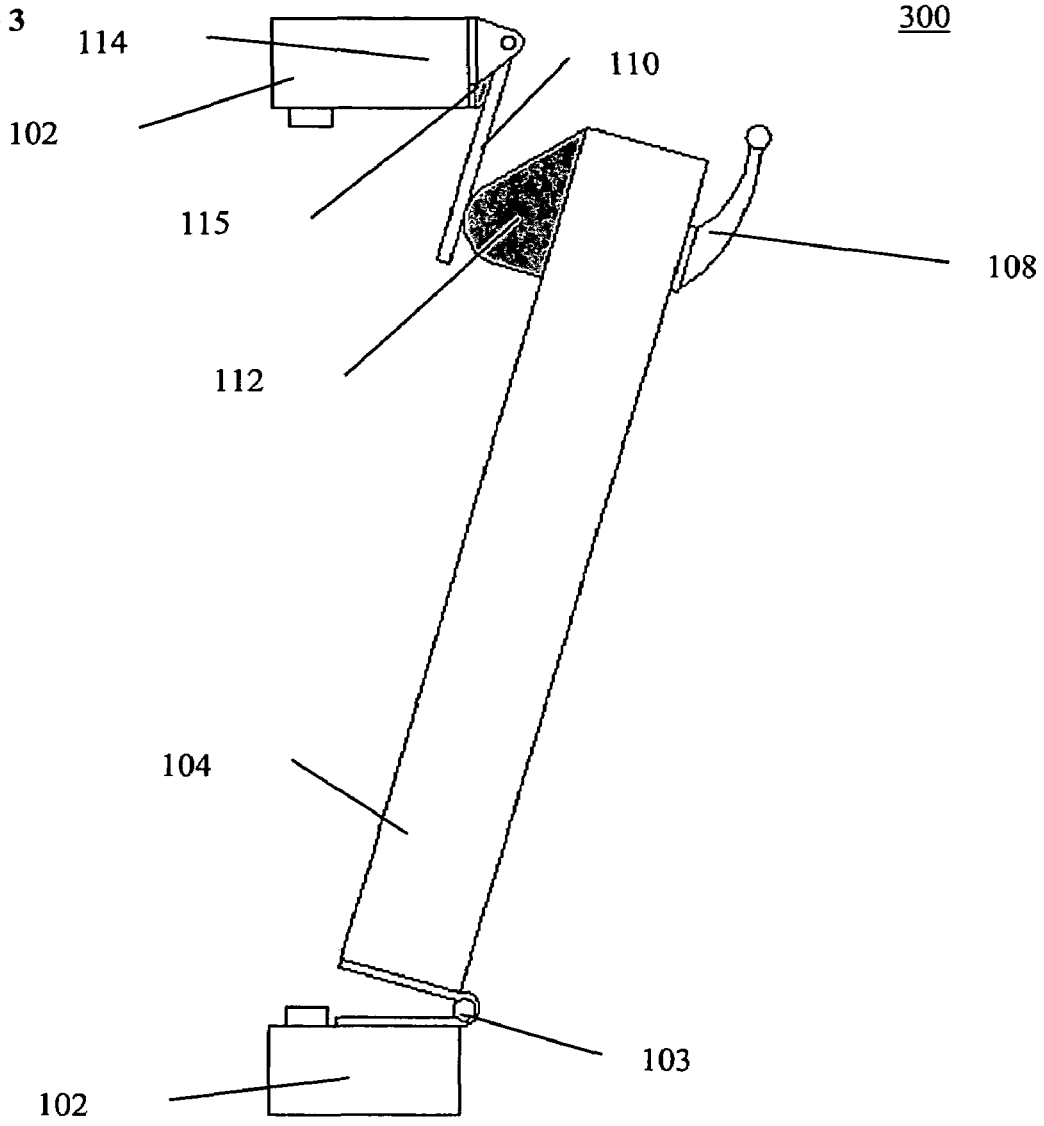
FIG. 3 is an above perspective of a door being propped ajar by a door guard, illustrating the present invention in operation.

FIG. 3 is an above perspective 300 of door 104 being propped ajar by the door guard showing an embodiment of the present invention. Latch 110 is not engaged (not closed upon hook 108). As shown, door 104 is propped open by latch 110. On the opposite side of door 104, in direct pathway to latch 110, is positioned a door sound damper 112. Placed between the latch 110 and door frame 102 is a frame sound damper 114. Door sound damper 112 and frame sound damper 114 are positioned to provide a cushion, or buffer, in order to decrease the sound and/or vibrations that occur when the door 108, latch 110, and door frame 102 interact. Without the door sound damper 112 and the frame sound damper 114, there is a loud sound or noise from impact of the door when the door 104 closes upon the latch 110, which in turn collides with door frame 102. The door sound damper 112 provides a reduction of sound and/or vibration upon impact between the latch 110 and the door 104. The frame sound damper 114 provides a reduction of sound and/or vibration upon impact between latch 110 and door frame 102.

The provision of the present invention on a hotel/motel door results in a significant reduction of sound and vibration upon impact. The sound decibel level was measured by a decibel-meter to decrease from 87 decibels (without the use of the door sound damper 112 and frame sound damper 114) to 20 decibels (when utilizing the door sound damper 112 and frame sound damper 114).

FIG. 4A is a perspective view 400 of frame sound damper 114 and latch 110 in a closed position and in view of a door frame. As described above, the frame sound damper 114 is placed between the latch 110 and door frame 102. The latch 110 is positioned atop the frame sound damper 114 and thus, they are both positioned (attached) at an appropriate height on the door frame 102.

FIG. 4B is a perspective view 402 of frame sound damper 114 and latch 110, where the latch 110 is in an open position. As described with respect to FIG. 4A, the latch 110 is positioned atop the frame sound damper 114 and thus, they are both positioned (attached) at an appropriate height on the door frame 102.

FIG. 5 is an above perspective view 500 of door sound damper 112 and its placement in view of door 104 and relation to hook 108. As described above in relation to FIG. 3, the door sound damper 112 is positioned on the opposite (outside) side of door 104 in relation to hook 108. This positioning is established so that when door 104 comes into contact with latch 110 (not pictured), the sound and vibrations due to impact are reduced. A flat-head screw, or other appropriate holding device, is used to attach the door sound damper to the door, so as to allow the door to close smoothly. It is to be understood that a portion of the door sound damper 112 also performs a function of damping sound when the door closes completely against the door frame, by providing a small cushion, or buffer.

Figure 6A:
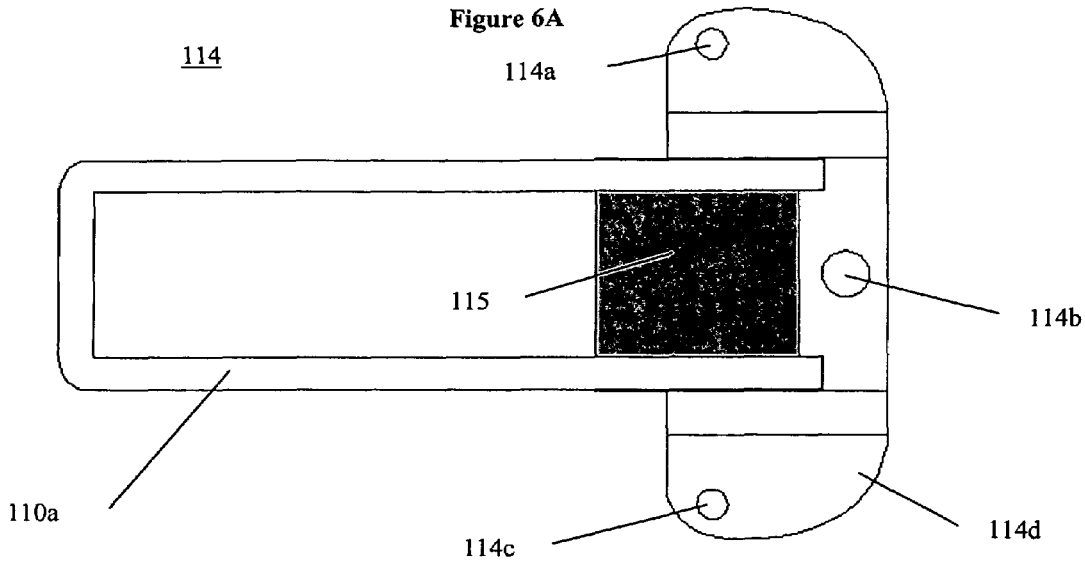
FIGS. 6A-C are three schematic views of the frame sound damper which detail components and positioning with respect to the latch.
Figure 6B:
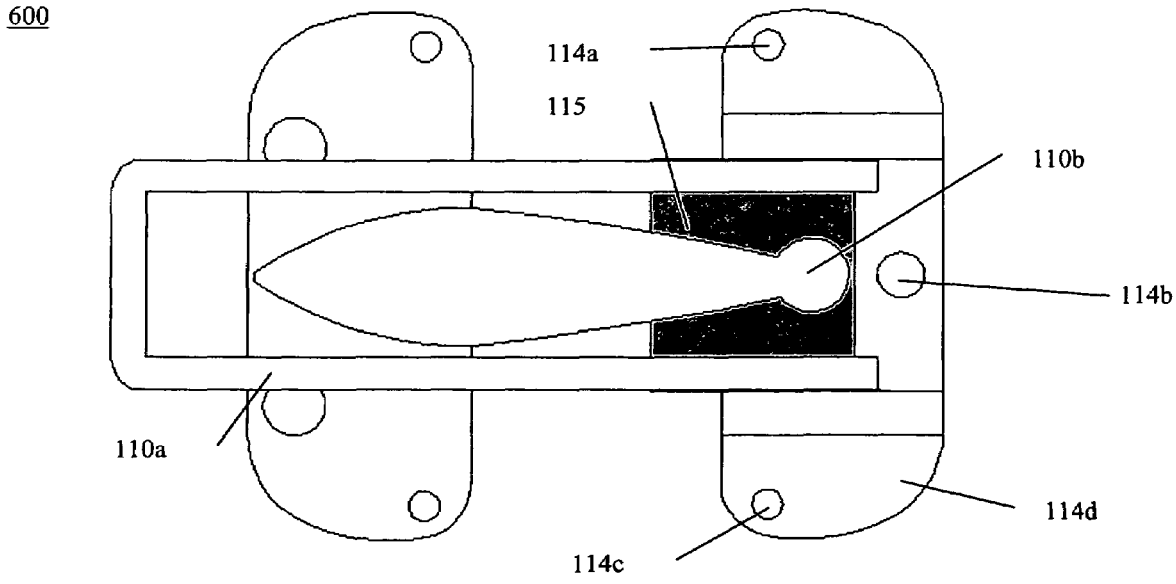
Figure 6C:
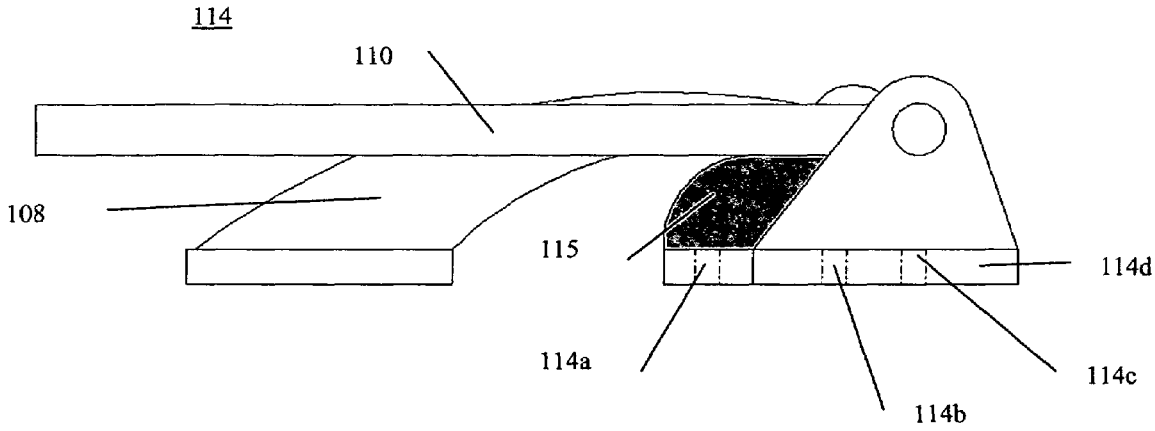

FIGS. 6A-C are three schematic views of frame sound damper 114 which detail components and positioning with reference to the latch 110 of a door guard. In FIG. 6A, the frame sound damper 114 is detailed. The latch damping article 115 is attached to the base (or washer) 114*d*. The latch damping article 115 is the effective element that provides the reduction of sound and/or vibration upon impact between latch 110 and frame 102 (not shown). Within the base 114*d*, are positioned one or more holes 114*a*, 114*b*, and 114*c*, which provide access for holding elements (e.g., nails, screws, bolts, etc.) to attach the frame sound damper 114 to the door frame 102.

Figure 12A:
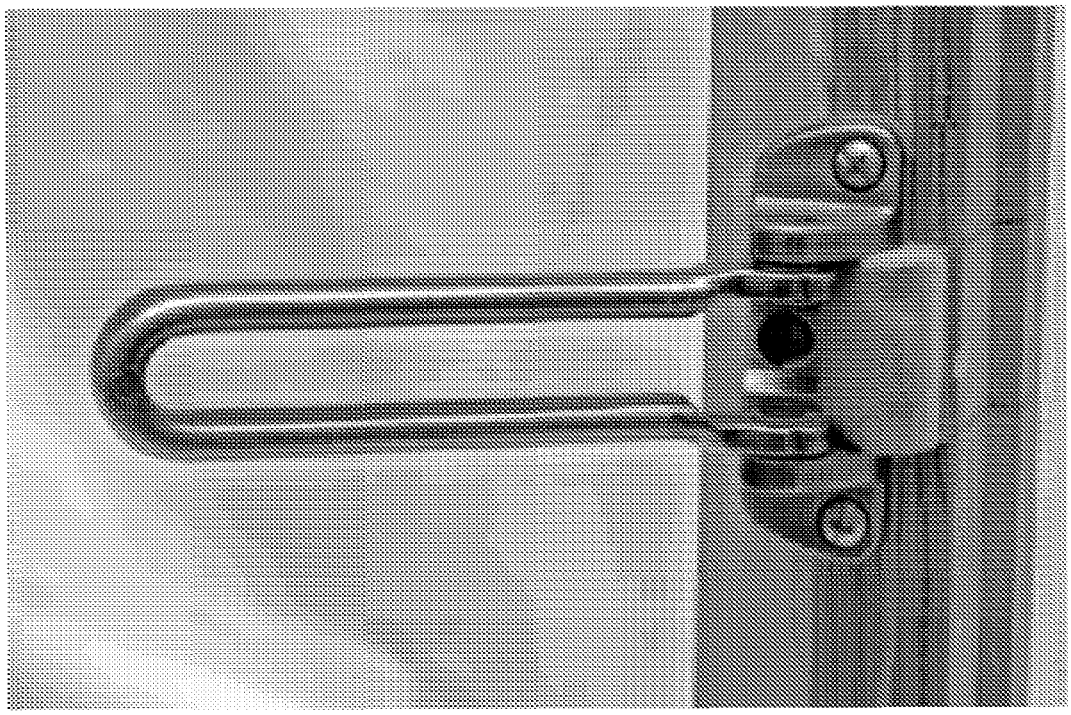
FIGS. 12A-B are photographs of the frame sound damper and the door sound damper in view of the door and door frame.

FIG. 6B provides a schematic view 600 of a detailed view of latch 110 positioned in reference to frame sound damper 114. The latch 110, in a closed position, interacts with the latch damping article 115 to provide reduction of sound and/or vibration upon impact with the door frame 102, as described above. The latch 110 is positioned atop the frame sound damper 114, where the hinge 110*b* of the latch 110 is positioned on the base 114*d*, and the arm 110*a* of latch 110 is positioned so that it comes into contact with latch damping article 115. The hinge 110*b* of the latch 110 is the hinge that connects the latch 110 to the door frame 102. The hinge 110*b* is shown in FIGS. 2-3 and 12A. The hinge 110*b* should not be confused with the door hinge 103 in FIG. 2, which is used to attach the door 104 to the door frame 102 and forms no essential part of the present invention (see FIG. 2).

FIG. 6C is a side perspective of the frame sound damper 114, which details the positioning and shape of latch damping article 115, base 114*d*, and holes 114*a*, 114*b*, and 114*c*, which are indicated via dotted lines since they are not be visible from a side perspective.

Figure 7:
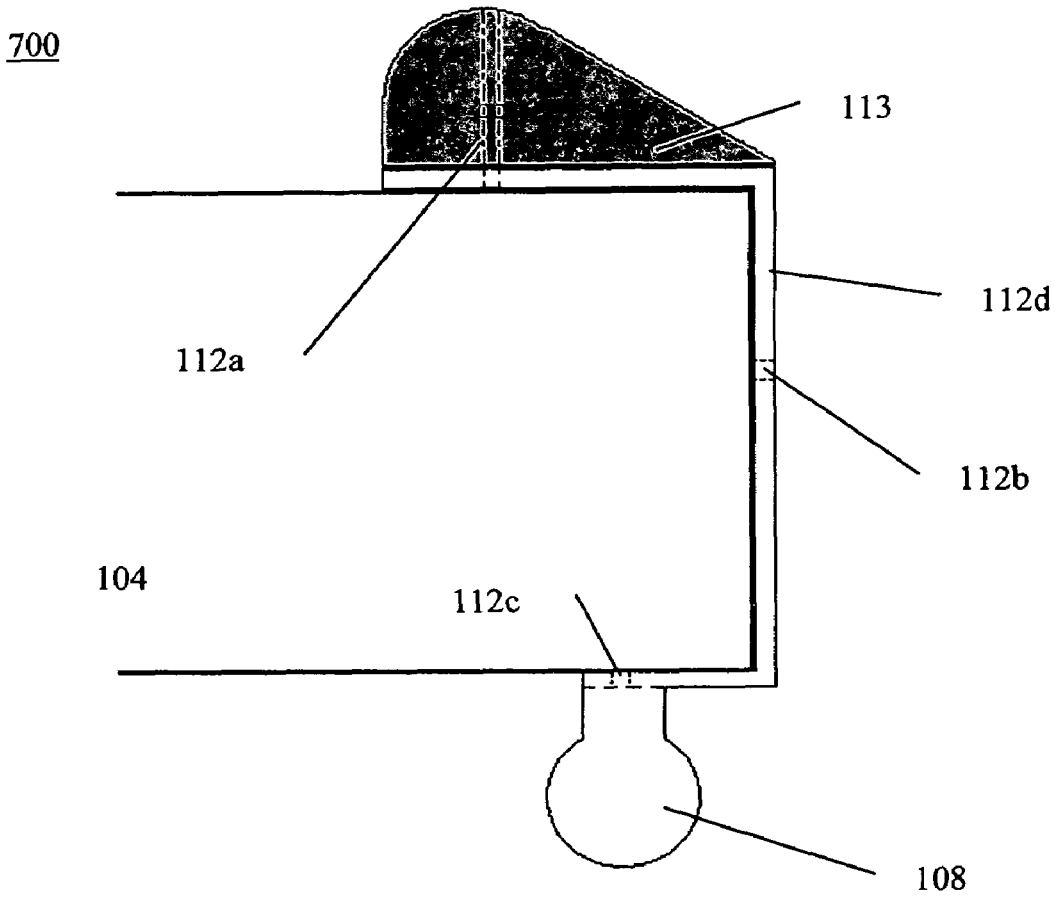
FIG. 7 is a schematic view of a side perspective of a door sound damper and hook.

FIG. 7 is a schematic view 700 of a side perspective of the door sound damper 112 and its components. The door damping article 113 is attached to a base (or washer) 112*d*. The door damping article 113 is the effective element that provides the reduction of sound and/or vibration upon impact between the latch 110 (not shown) and the door 104. Within the base 112*d* are provided one or more holes 112*a*, 112*b*, and 112*c* which provide access for attachment elements (e.g., nails, screws, bolts, etc.) to attach the door sound damper 112 to the door 104. The hole 112*a* is also shown (in dotted lines) through door damping article 113 in order to provide attachment of the door damping article 113 and the base 112*d* to the door 104. Base 112*d* (also known as "joining element") wraps around the width of the door and connects to where the hook 108 attaches to the door. The hole 112*b* shows that door sound damper 112 is connected to hook 108 and the door 104. Normally, a flat-head screw, or other appropriate holding device, is used in hole 112*b* in order to allow the door to close smoothly. The hook 108 with ball on one end is also connected (via, screws, bolts, etc.) to door 104 via hole 112*c*.

Figure 8:
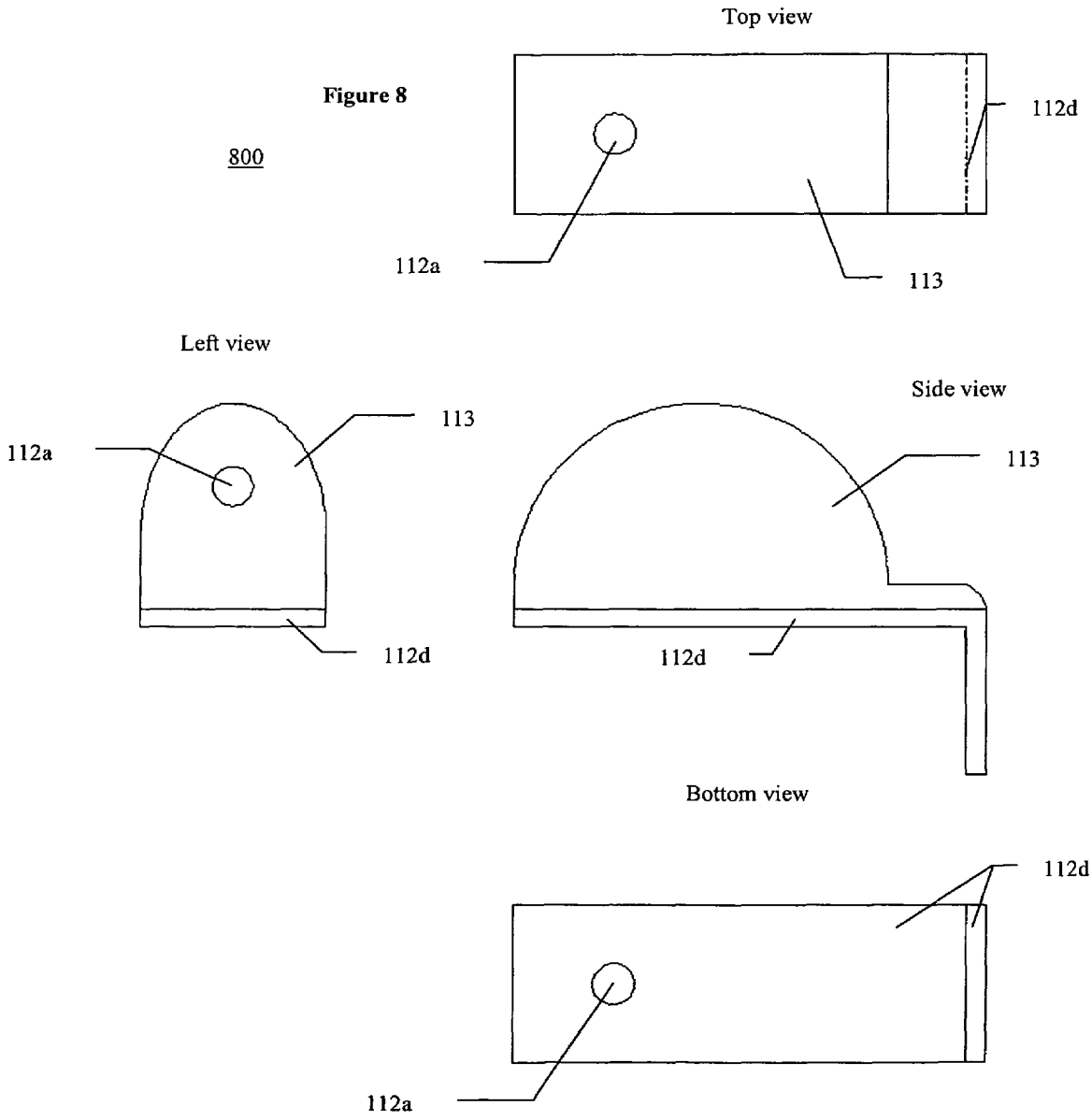
FIG. 8 is an engineering drawing of a door sound damper.

FIG. 8 is an engineering drawing 800 of the door sound damper 112 utilizing the American standard which places the left view on the left and the top view on the top, thereby detailing four perspective views. The top view is an above perspective of the door sound damper 112 which shows hole 112*a*, damping article 113, where a dotted line is utilized to indicate a crease in damping article 113, and base 112*d*, also indicated via a dotted line. The side view is a perspective from the side of the door sound damper 112, which shows damping article 113 and base 112*d*. The bottom view is a perspective from underneath door sound damper 112, which shows hole 112*a* and base 112*d*, where a portion of base 112*d* is indicated with a dotted line to indicate that portion which extends around the door 104. The left view is a perspective view from the left side of door sound damper 112, showing hole 112*a*, damping article 113, and base 112*d* from a left view. It is to be understood that a portion of the door sound damper 112 also performs a function of damping sound when the door closes completely against the door frame, by providing a small cushion, or buffer.

Figure 9A:
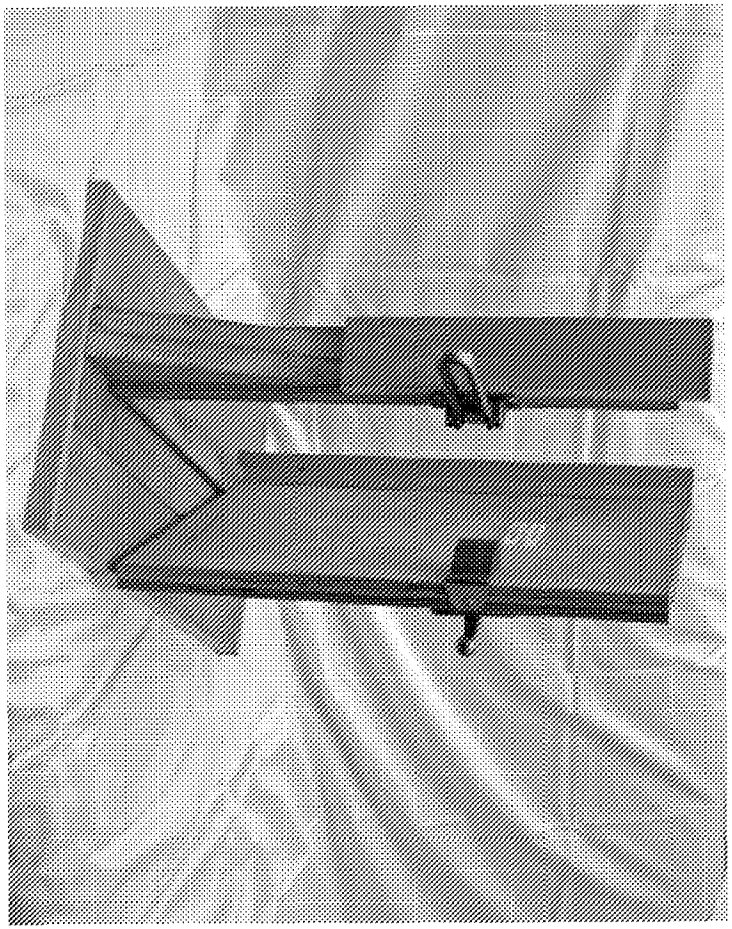
FIGS. 9A-B are photographs of the door guard in view of a door and door frame in unlocked and locked positions, respectively.
Figure 9B:
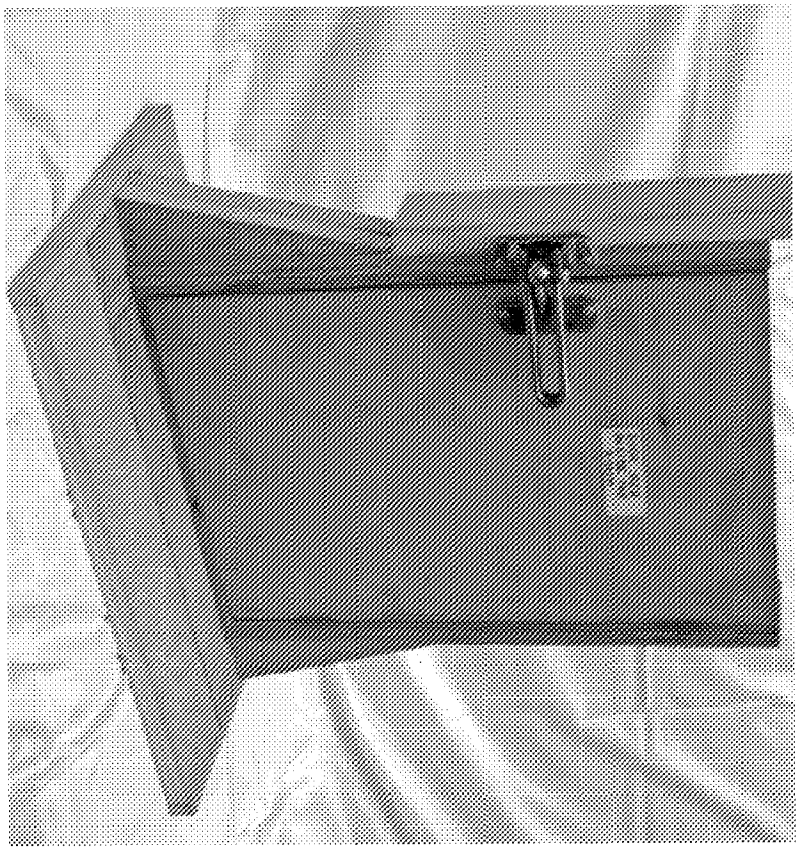

FIGS. 9A-B are photographs of the door guard in view of the door 104 and the door frame 102. These photographs correspond to the subject matter discussed in relation to FIGS. 1A-B. FIG. 9A displays the hook 108 and latch 110 in an open position, and FIG. 9B displays the hook 108 and latch 110 when they are engaged or closed.

Figure 10A:
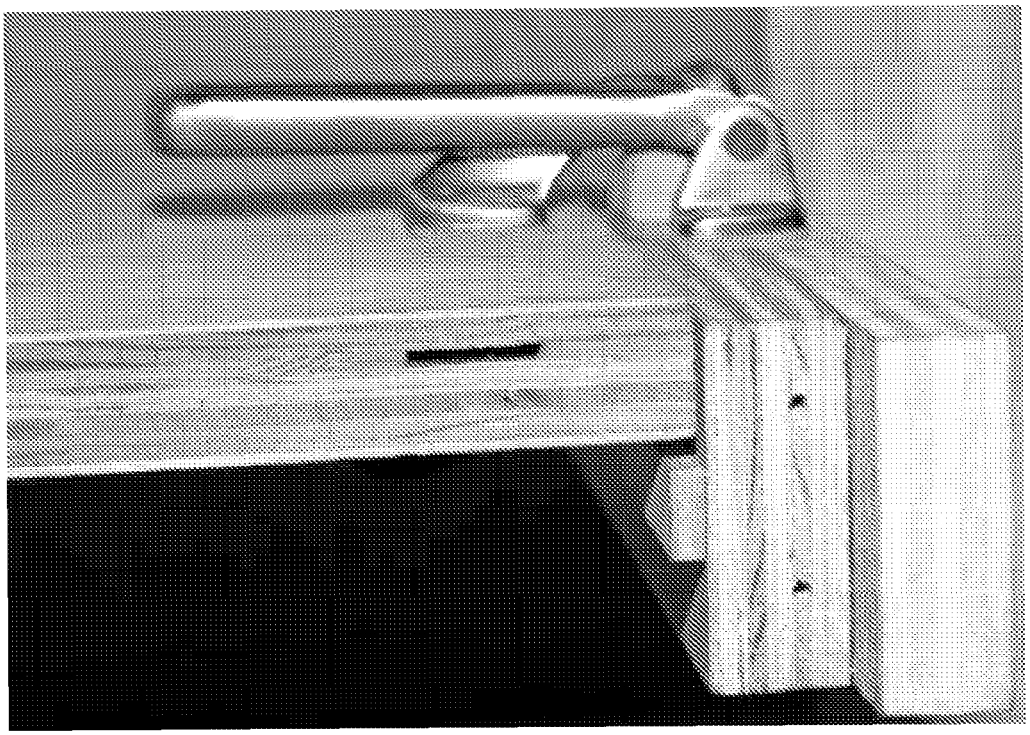
FIGS. 10A-B are photographs of the door guard engaged in locked and unlocked positions, respectively.
Figure 10B:
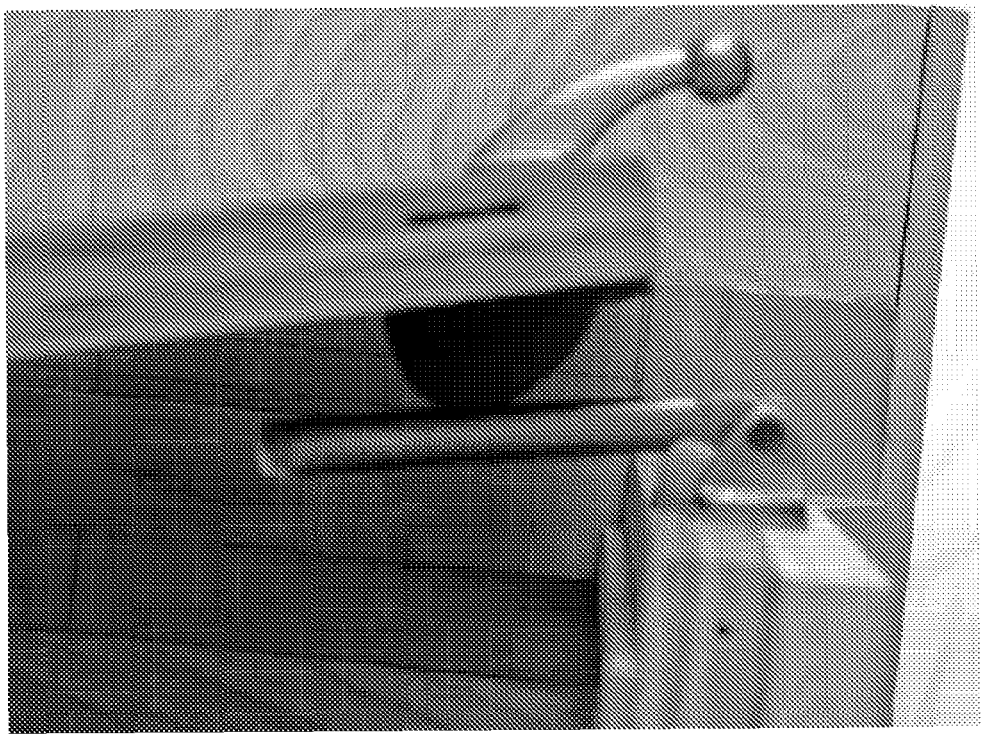

FIGS. 10A-B are photographs of the door guard engaged in two different positions. FIG. 10A corresponds to the subject matter discussed in FIG. 2 showing the door guard (latch 108 and hook 110) engaged when locking the door 104. FIG. 10B corresponds to the subject matter discussed in FIG. 3 showing door 104 being propped ajar by the door guard. The latch 110 is not engaged (not closed upon hook 108). As shown, door 104 is propped open by the latch 110. On the opposite side of the door 104, in direct pathway to the latch 110, is positioned a door sound damper 112. Placed between the latch 110 and the door frame 102 is a frame sound damper 114. The door sound damper 112 and the frame sound damper 114 are positioned to provide a cushion, or buffer, in order to decrease the sound and/or vibrations that occur when the door 108, latch 110, and door frame 102 interact.

Figure 11A:
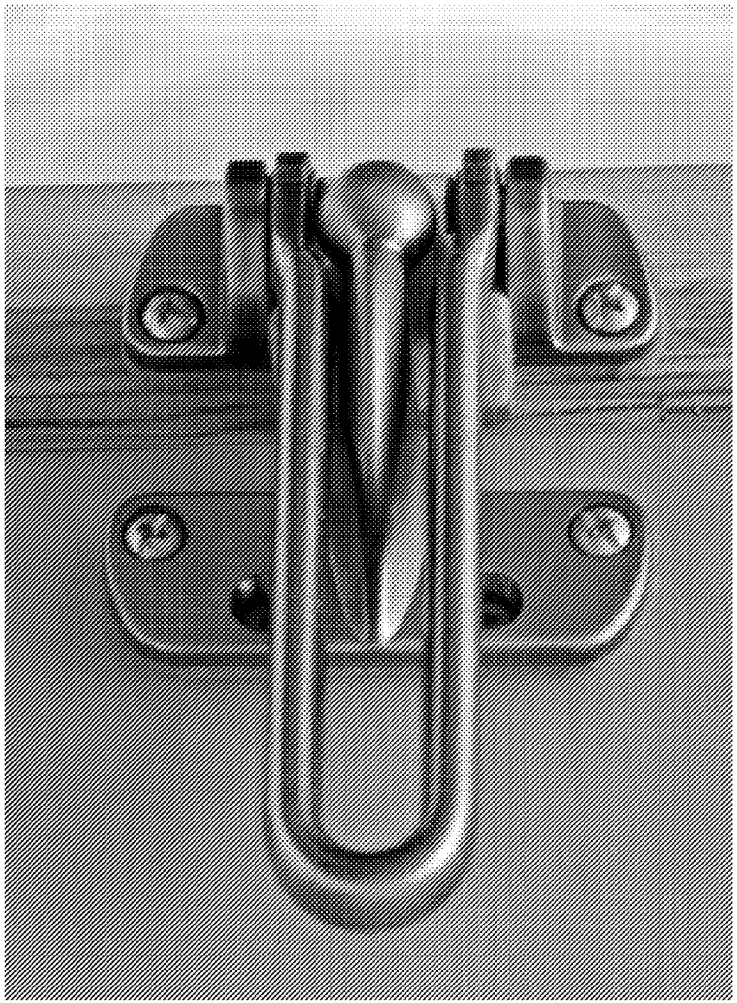
FIGS. 11A-B are photographs of the frame sound damper and latch in view of the door and door frame.
Figure 11B:
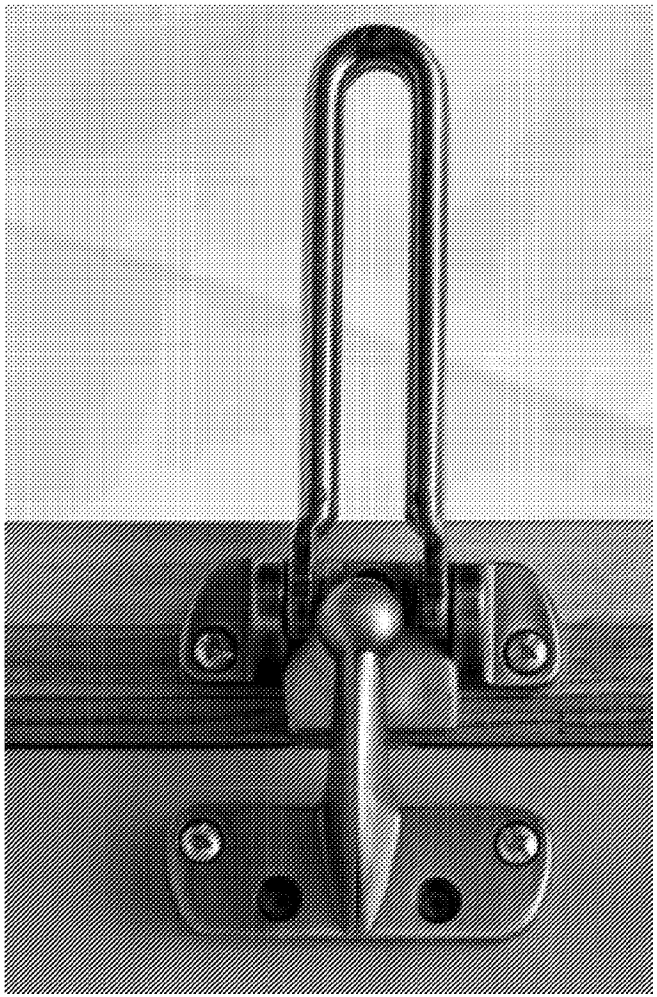

FIGS. 11A-B are photographs of the frame sound damper 114 and the latch 110 in view of the door 104 and the door frame 102. FIGS. 11A-B correspond to the subject matter discussed in FIGS. 4A-B. FIG. 11A shows the frame sound damper 114 and the latch 110 in a closed position in view of a door frame. FIG. 11B shows the frame sound damper 114 and the latch 110 in an open position.

Figure 12B:
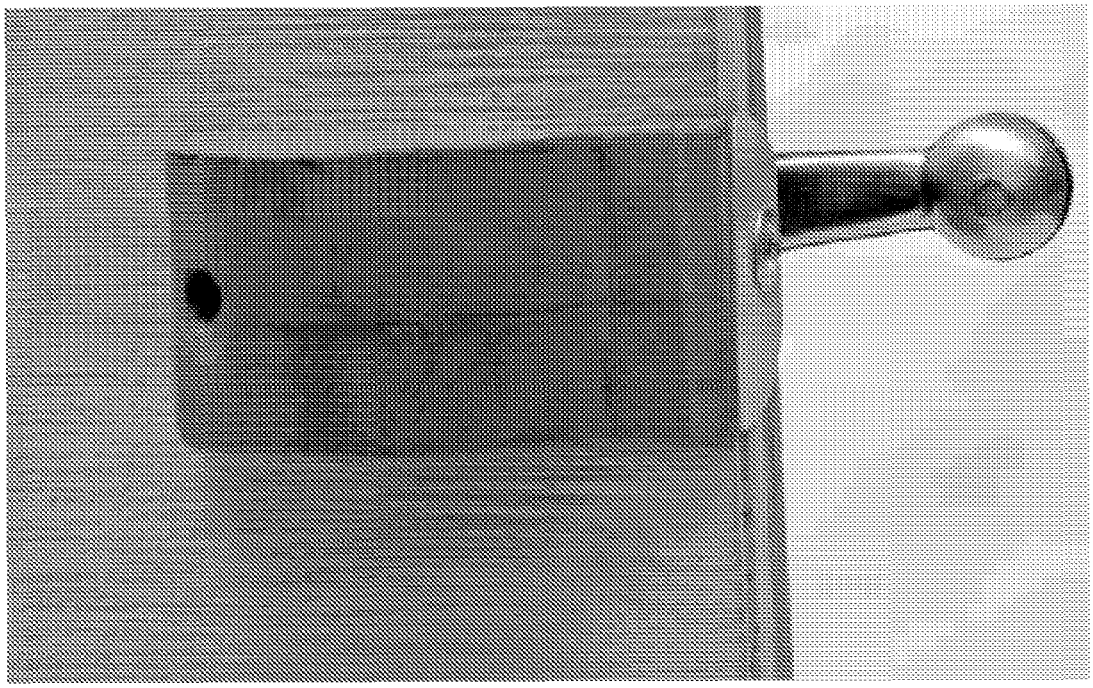

FIGS. 12A-B are photographs of the frame sound damper 114 and the door sound damper 112 in view of the door 104 and the door frame 102. FIG. 12A corresponds to the subject matter discussed in FIG. 4B showing the frame sound damper 114 and the latch 110 in an open position. FIG. 12B corresponds to the subject matter of FIG. 5, showing the door sound damper 112 and its placement relation to the door 104 and the hook 108.

Figure 13A:
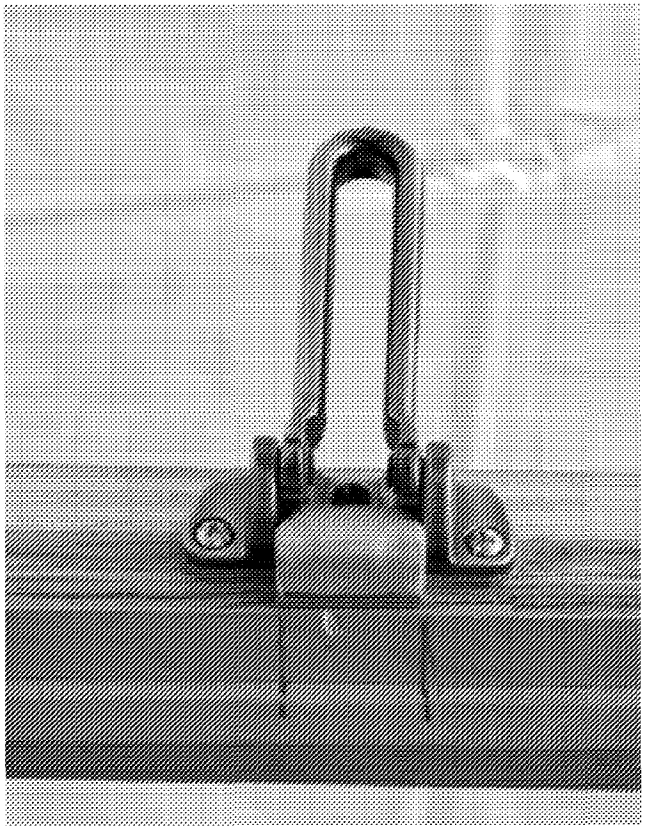
FIGS. 13A-B are photographs of the frame sound damper and the door sound damper in view of the door and door frame from other perspectives.
Figure 13B:
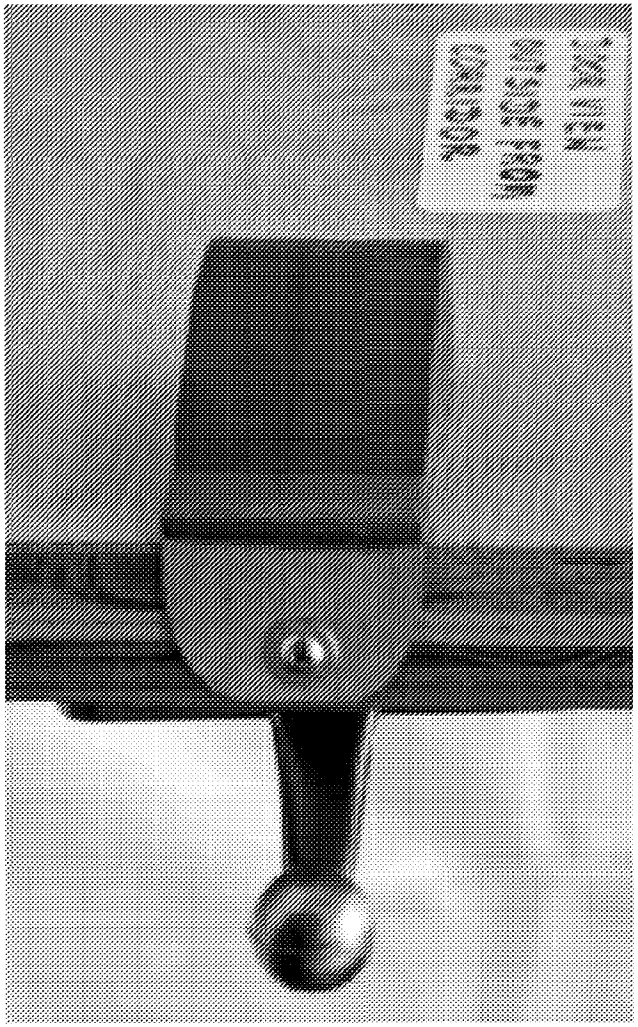

FIGS. 13A-B are photographs of the frame sound damper 114 and the door sound damper 112 in view of the door 104 and the door frame 102 from alternative perspectives. FIGS. 13A-B correspond to alternative views of FIGS. 12A-B, showing the door sound damper 112 and the frame sound damper 114, and their relative positioning on the door 104 and the door frame 102.

Figure 14A:
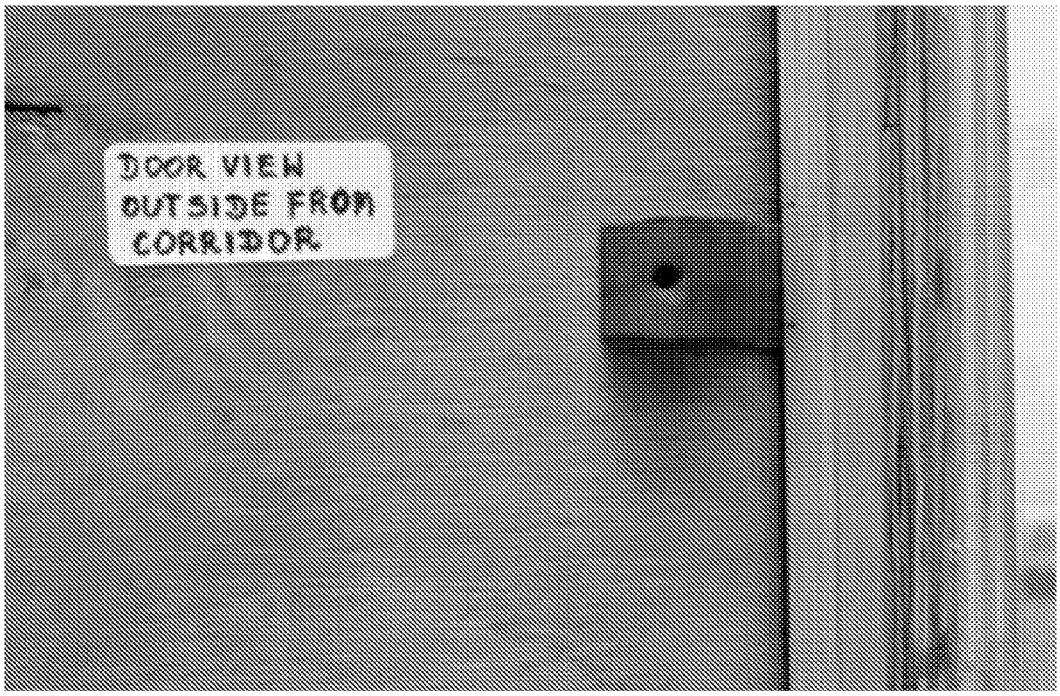
FIGS. 14A-B are photographs of the door sound damper in closed and ajar positions, respectively.
Figure 14B:
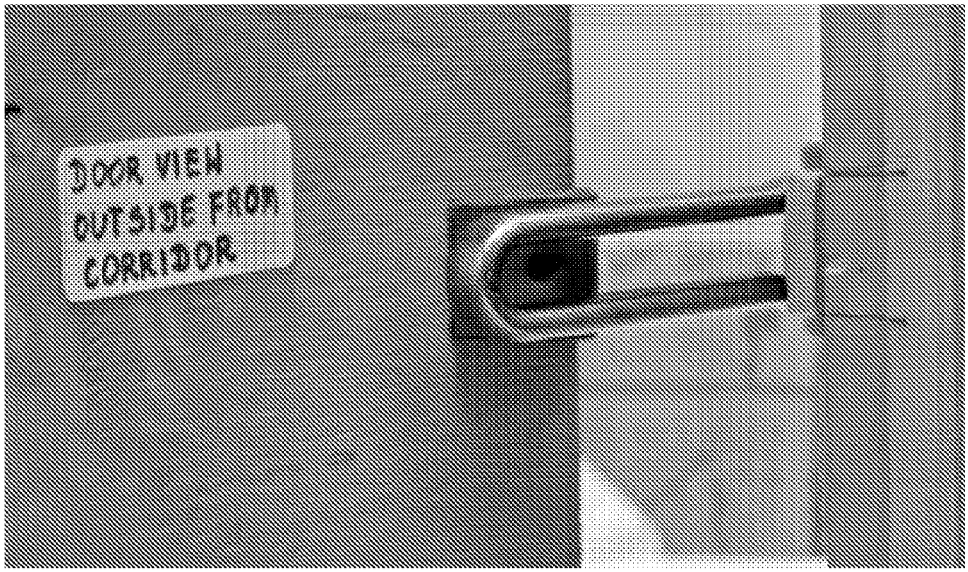

FIGS. 14A-B are photographs of the door sound damper 112 in closed and ajar positions, respectively. FIG. 14A shows the door 104, with door sound damper 112 attached, in a closed position without impedance from hook 110, as discussed above. FIG. 14B shows the door 104, with door sound damper 112 attached, propped ajar via latch 110 and sound damper 112, as discussed above.

The following are various illustrative embodiments of the present invention, and are not intended to limit the scope or spirit of the present invention, which is defined solely by the appended claims.

An article, to be attached to a door, for suppressing sound when the door strikes a door latch, comprising:

a hook element adapted to receive a latch member of the door latch and adapted to be attached to an inside surface of the door; and a damping element, composed of a sound dampening material, adapted to be attached to an outside surface of the door.

The article described above, further comprising a joining element to join the hook element and the damping element and adapted to be attached to a side surface of the door.

The article described above, further comprising a separator element disposed between the joining element and the outside surface of the door.

The article described above, wherein the sound dampening material is a rubber.

The article described above, wherein the sound dampening material is recycled tire rubber.

The article described above, further comprising an extension element, connected at approximately a right angle to a bottom surface of the damping element, adapted to attach to a side surface of the door.

The article described above, wherein the damping element and the hook element have one or more holes adapted to receive one or more holding members for attaching the article to the door.

The article described above, wherein the one or more holding members are either screws, nails, bolts, or self-threading screws.

An article, to be attached to a door frame, for suppressing sound when a door strikes the door frame, comprising:

a hinge element for connecting said article to the door frame;

a latch member pivotally connected to the hinge element and adapted to latch with a hook; and a damping element, composed of a sound dampening material, disposed between the hinge element and the latch member.

The article described above, wherein the sound dampening material is a rubber.

The article described above, wherein the sound dampening material is recycled tire rubber.

The article described above, further comprising one or more holes through the hinge element adapted to receive one or more holding members for attaching the hinge element to the door frame.

The article described above, wherein the one or more holding members are either screws, nails, bolts, or self-threading screws.

The article described above, wherein the damping element is connected to the hinge element.

The article described above, further comprising a separator element disposed between the damping element and door frame.

The article described above, wherein the damping element is connected to the latch member.

A system for suppressing noise when a door strikes a door latch on a door frame, wherein the door comprises:

a hook member attached to an inside surface of the door; and a first damping element, composed of a sound dampening material, attached to an outside surface of the door; and wherein the door frame comprises:

a hinge element attached to the door frame at a same height as the hook member;

a latch member pivotally connected to the hinge element and adapted to latch with the hook member; and a second damping element, composed of a sound dampening material, disposed between the hinge element and the latch member.

A system for suppressing noise when a door strikes a door frame, comprising:

a hook member attached to an inside surface of the door and adapted to receive a latch;

a first damping element, composed of a sound dampening material, attached to an outside surface of the door;

a hinge element attached to the door frame at a same height as the hook member;

a latch member pivotally connected to the hinge element and adapted to latch with the hook member; and a second damping element, composed of a sound dampening material, disposed between the hinge element and the latch member.

A system for suppressing noise when a door strikes a door latch frame, comprising:

a first damping element, composed of a sound dampening material, attached to an outside surface of the door; and a second damping element, composed of a sound dampening material, disposed between a hinge element and a latch member of the door latch.

An article, to be attached to a door, for suppressing sound when the door strikes a door latch, comprising:

a damping element, composed of a sound dampening material;

a separator element, connected to the damping element, and adapted to be attached to an outside surface of the door; and an extension element, connected at approximately a right angle to a bottom surface of the damping element, and adapted to be attached to a side surface of the door.

The article described above, further comprising one or more holes through the damping element, the separator element, and the extension element for receiving one or more holding members for attaching the article to the door.

An article, to be attached to a door latch of a door frame, for suppressing sound when a door strikes the door latch, the door latch having a hinge element and a latch member pivotally connected to the hinge element, the article comprising:

a damping element, composed of a sound dampening material, adapted to be disposed between the hinge element and the latch member; and a separator element adapted to be disposed between the damping element and the door frame.

The article described above, further comprising one or more holes through the damping element and the separator element for receiving one or more holding members for attaching the article to the hinge element and the door frame.

An article for attachment to a door, comprising:

hook means for receiving a latch member attached to a door frame, said hook means adapted to be attached to an inside surface of the door; and damping means for dampening sound and adapted for attachment to an outside surface of the door.

The article described above, further comprising door attachment means for attaching said article to the door and connected to the hook means and the damping means.

The article described above, wherein the damping means and the door attachment means have one or more means for receiving holding members for attaching the article to the door.

An article for attachment to a door frame, comprising:

hinge means for pivotally hinging;

latch means for latching to a hook, pivotally connected to the hinge means; and damping means for damping sound disposed between the hinge means and the latch means.

The article described above, further comprising one or more means for receiving one or more holding members for attaching the hinge means to the door frame.

A system for suppressing noise when a door strikes a door frame, wherein the door comprises:

hook means for receiving a latch and attached to an inside surface of the door; and first damping means for dampening sound attached to an outside surface of the door; and wherein the door frame comprises:

hinge means for pivotally hinging;

latch means for latching to the hook means of the door and pivotally connected to the hinge means; and second damping means for damping sound disposed between the hinge means and the latch means.

An article for attachment to a door with a door latch, the article comprising:

damping means for damping sound; and attaching means for attaching the damping means to an outside surface of the door at a same height as the door latch.

An article for attachment to a door latch for a door, the door latch having a means for hinging and a means for latching pivotally connected to the means for hinging, the article comprising:

dampening means for damping sound disposed between the means for hinging and the means for latching; and attaching means for attaching the damping means to the means for hinging.

A method for damping sound when a door strikes a door frame with a door latch, the door latch having a latch member pivotally connected to a hinge, the method comprising the steps of:

attaching a first damping element to the door at a same height as the door latch; and attaching a second damping element between the hinge and the latch member of the door latch.

The method described above, wherein when the door strikes the latch member of the door latch, the first damping element decreases sound of collision of the door with the latch member, and the second damping element decreases sound of collision of the latch member with the hinge.

The method described above, wherein when the door strikes the latch member of the door latch, the sound produced is less then without the use of the first damping element or the second damping element.

A door latch for a door, comprising:

a hinge element;

a latch member pivotally connected to the hinge element and adapted to be received by a hook; and a damping element, composed of a sound dampening material, disposed between the hinge element and the latch member.

The door latch described above, wherein the hinge element is a metal plate with three holes for screws, and wherein the damping element is approximately L-shaped.

The door latch described above, further comprising:

a hook element adapted to receive the latch member and adapted to be attached to an inside surface of the door; and a second damping element, composed of a sound dampening material, adapted to be attached to an outside surface of the door.

The door latch described above, further comprising a C-shaped metal plate attached to the hook element and the second damping element, having two holes for screws.

The door latch described above, wherein the second damping element is approximately D-shaped.

It is to be understood that the material used to construct the door sound damper 112 and the frame sound damper 114 may be rubber, recycled tire rubber, or any other suitable sound-dampening material known in the art. The door may be any door, including a left door, a right door, a metal door, a plastic door, or a door made of any other material. The present invention may be readily applied to any door, and to any door guard, including a hotel/motel door, a guest door, a home door, etc. The present invention is by no means limited in its application to a hotel/motel door.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

What is claimed is:

1. A system, comprising:

a door, comprising:

a hook member attached to an inside surface of the door;

a first damping element, composed of a sound dampening material, attached to an outside surface of the door; and an approximately C-shaped metal plate connected to the hook member and the first damping element, the metal plate attached to the door; and a door frame, comprising:

a hinge element attached to the door frame at a same height as the hook member;

a latch member pivotally connected to the hinge element and adapted to latch with the hook member; and a second damping element, composed of a sound dampening material, disposed between the hinge element and the latch member, wherein noise is suppressed when the door strikes the latch member on the door frame.

2. A method for reducing sound when a door strikes a door frame with a door guard, the door guard having a latch pivotally connected to a hinge, the method comprising the steps of:

attaching to the door, at a same height as the latch, an approximately C-shaped metal plate, the metal plate having a hook at one end for hooking with the latch and a first damping element at an opposite end made of sound dampening material; and attaching a second damping element made of sound dampening material between the hinge and the latch of the door guard, wherein when the door strikes the latch of the door guard, the first element decreases sound of collision of the door with the latch, and the second element decreases sound of collision of the latch with the hinge.

3. A door guard for suppressing sound when a door strikes the door guard, comprising:

a hinge with one or more holes for screws for attachment to a door frame;

a latch pivotally connected to the hinge;

a first damper, made of a sound dampening material and approximately L-shaped, disposed between the hinge and the latch for suppressing sound associated with the hinge striking the latch;

a hook adapted to receive the latch;

a second damper, made of a sound dampening material and approximately D-shaped, adapted to be attached to an outside surface of the door for suppressing sound associated with the door striking the latch; and an approximately C-shaped metal plate connected to the hook on one end and the second damper on an opposite end, the metal plate having one or more holes for attachment to the door and shaped to be attached to the door.

4. The door guard according to claim 3, wherein the sound dampening material is made from soft rubber.

* * * * *

UNITED STATES PATENT AND TRADEMARK OFFICE

CERTIFICATE OF CORRECTION

PATENT NO. : 7,360,804 B1
APPLICATION NO. : 11/610843
DATED : April 22, 2008
INVENTOR(S) : Wlodzimierz Fidali and Robert T. Logan It is certified that error appears in the above-identified patent and that said Letters Patent is hereby corrected as shown below:

Title Page, item [73] Assignee should read as follows: Senduzy Corp. (New York, NY, US)

Signed and Sealed this

Seventh Day of December, 2010

David J. Kappos

David J. Kappos
*Director of the United States Patent and Trademark Office*